US005524775A

United States Patent [19]

Kaine

[11] Patent Number: 5,524,775

[45] Date of Patent: Jun. 11, 1996

[54] ROTARY DEVICE FOR STORING ARTICLES AND/OR FILING DOCUMENTS

[76] Inventor: Michel Kaine, 43, Holten Avenue, Westmount, Quebec, Canada, H3Y 2G1

[21] Appl. No.: 365,753

[22] Filed: Dec. 29, 1994

[51] Int. Cl.[6] ..... A47F 5/00

[52] U.S. Cl. ..... 211/131; 108/103; 211/10; 211/144; 211/163

[58] Field of Search ..... 211/163, 131, 211/10, 58, 144; 312/305, 135, 186; 108/103, 139, 27

[56] References Cited

U.S. PATENT DOCUMENTS

| | | | |
|---|---|---|---|
| 274,087 | 3/1883 | Danner | 211/131 X |
| 1,930,844 | 10/1933 | Ruddell | 211/144 |
| 2,081,856 | 5/1937 | Frick | 211/144 X |
| 2,118,444 | 5/1938 | Mueller | 211/131 |
| 2,411,950 | 12/1946 | Yzetta | 211/131 X |
| 2,553,507 | 5/1951 | Rosenberg | 211/131 |
| 3,056,506 | 10/1962 | Fuller et al. . | |
| 3,747,754 | 7/1973 | Nix et al. . | |
| 3,860,120 | 1/1975 | Victor | 211/144 X |
| 3,868,916 | 3/1975 | Ohlson | 108/103 |
| 4,049,330 | 9/1977 | Schlapp . | |
| 4,050,751 | 9/1977 | Stange . | |
| 4,453,326 | 6/1984 | Hoffman et al. . | |
| 4,472,898 | 9/1984 | Tanaka . | |
| 4,534,473 | 8/1985 | Post | 211/131 X |

FOREIGN PATENT DOCUMENTS

| | | |
|---|---|---|
| 2099474 | 6/1993 | Canada . |

*Primary Examiner*—Robert W. Gibson, Jr.
*Attorney, Agent, or Firm*—Fishman, Dionne & Cantor

[57] ABSTRACT

The rotary device includes a center pillar mounted in a pedestal, and rotatable circular plates or shelves mounted to individually freely rotate about the pillar. Vertical partitions are mounted on at least some of the shelves. These partitions extend from the central area of a shelf towards but short of the periphery thereof at which point a perpendicular wing is provided to constitute a guard. The ratio between the length of the partition and that of the wing is adjusted so as to maximize the area of the circular shelf which is used for storing articles and for filing documents, thereby leaving a negligible unused area of the shelf.

5 Claims, 4 Drawing Sheets

ROTARY DEVICE FOR STORING ARTICLES AND/OR FILING DOCUMENTS

BACKGROUND OF INVENTION

1. Field of the Invention

This invention relates to a rotary device for storing articles and/or filing documents. More specifically, the present invention is concerned with a rotary storage and filing device of the type wherein a plurality of circular shelves or plates are mounted to freely rotate about a center pillar, and which is constructed to optimize the use of the space which is available for storing and/or storing in said shelves or plates. The invention is also directed to such a rotary device which is associated with a file rest support which can be used even with part of a shelf or plate.

2. Description of Prior Art

Rotary filing cabinets are well known, particularly in the field of active filing and retrieval. They are mainly used for conventional file folders, ring binders, reference cards, computer printouts, microfiche, artwork, plans, etc. One of their main advantage is that they provide faster initial document filing and subsequent retrieval by means of file movement. The file is brought to hand by simply spinning the tier. Records can be retrieved more swiftly by eliminating much of the searching and movement around an office. Another advantage is that they provide multiple access, and in many cases they are designed so that their individual tiers rotate independently which means that, in most cases, several people can use the device at the same time. It was found out that a well designed rotary system can offer significant saving of office space.

However, these filing and storage devices are restricted for use with only certain types of articles such as those mentioned above. Many items such as books, small boxes, computer related parts, and office equipment in general should normally be stored in these types of devices to provide multiple access and neat storage, but because of their present construction, they have not been found to be very convenient, at least for the latter mentioned purpose.

This has partially been offset by providing dividers for the shelves or plates to define radial compartments as described in U.S. Pat. No. 4,049,330 (Schlapp). The Schlapp device, however does not provide a convenient storage for any articles which differ from files in sizes and shapes, such as books, boxes and the like.

Another well known device is the one described and illustrated in U.S. Pat. No. 4,453,326 (Hoffman) which is particularly adapted for use in an office for holding documents. This device provides for the holding and segregating of documents in a cylindrical container in which partitions are radially and removably mounted therein. This device is obviously not adaptable to hold and more specifically to facilitate retrieval of other types of articles such as books and the like mentioned above.

Canadian Patent Application No. 2,099,474, laid opened on Jan. 1, 1994, describes a rotary filing system wherein partitions may be moved towards or away from a central column, and which includes two arched doors which may be moved depending on the positions occupied by the partitions. The same is true with respect to the cover which can be adjusted in size depending on the positions of the partitions. The system is designed to be easily modified and assembled or dismantled. It is mainly characterized by movable partitions, doors and cover and is not concerned by maximizing the available storage space.

Other file storage devices of interest are described in the following U.S. Pat. Nos.:

3,056,506 (Fuller et al)

3,747,754 (Nix et al)

4,050,751 (Stange)

4,472,898 (Tanaka)

These devices are all concerned with the provision of radial compartments for the purpose of filing and easily retrieving documents. However, they are not easily adapted for use with a plurality of types of articles.

A review of the prior art also indicates that rotary storage and filing devices lack a means associated with vertical partitions which prevents accidental escapes of articles from the rotary device, and at the same time permits to use a maximum amount of storage space.

It has also been realized that the rotary devices of the prior art do not permit the alternative use of the devices for storing articles and filing documents in a neat and efficient manner.

There is therefore a need for a filing and storage device which at the same time enables to optimize the amount of storage and filing space which is available, even with the presence of a means associated with each partition which prevents the easy escape of articles stored therein.

SUMMARY OF INVENTION

It is an object of the present invention to provide a rotary storage and/or filing device which enables to optimize the use of the space which is available for storage and/or filing.

It is another object of the present invention to provide a multi-purpose rotary device which includes a file rest support enabling to neatly place file documents in a given compartment, where a much large storage area has been provided.

These and other objects of the present invention may be achieved in a rotary device for storing articles and/or filing documents which includes an upstanding center pillar having one end disposed on a pedestal, at least one circular plate mounted for free rotation about the center pillar and means enabling this free rotation of the circular plate. The device according to the invention comprises a plurality of partitions mounted vertically on at least one of the plates, the partitions extending from a central area of the plate towards, but short of the periphery thereof. A wing is provided perpendicularly at the outer end of each of the partitions to constitute a guard. The ratio between the length of the partition and that of wing is adjusted so as to maximize the area of the circular plate which is used for storing the articles and/or for filing the documents, thereby leaving a negligible unused plate area.

In accordance with a preferred embodiment of the invention, the rotary device comprises a plurality of circular plates spacedly arranged over one another, and the above partitions may be provided with each circular plate.

In accordance with another preferred embodiment of the invention, a terminal plate is mounted at the other end of the center pillar, spacedly from the uppermost circular plate. Preferably, there are four partitions for each circular plate, in which case they are usually perpendicular to one another.

In accordance with yet another preferred embodiment of the invention, each partition has its inner end fixed against one face of a next partition short of the inner end of the latter.

The length ratio between the partition and the wing attached thereto may vary to quite an extent, provided it is substantially greater than 1, for example, this ratio may be above 3:1.

In accordance with another preferred embodiment according to the invention, the rotary device comprises a file rest support which is disposed over some vertical partitions and is constructed and arranged to constitute an abutment for resting the rear edges of files to be placed on the circular plates, thereby limiting the extent of insertion of a file to a predetermined value.

One example of such file rest support is in the form of a disc member, which has an opening to insert the center pillar there through, a downwardly extending outer rim constituting an abutment for resting the rear edges of files and slits provided in the rim into which the upper edges of the vertical partitions are engaged, and additionally upper edges of any further removable partitions that may be introduced between two adjacent vertical partitions. The disc has a diameter which is adjusted to the depth of the files to be disposed on the circular plates.

Another example of such file rest support is shaped as a section of annulus having a front arc and a rear arc and two ends. A rim downwardly projects from the front arc, and is provided with slits to receive therein the upper edges of the vertical partitions and additionally the upper edges of any further removable partitions that may be introduced between two adjacent vertical partitions. Downward tongues are provided at the ends of the section of annulus and are shaped to engage over the top edges of the vertical partitions. The section of annulus has a width which is adjusted to the depth of files to be disposed on the circular plates.

BRIEF DESCRIPTION OF DRAWINGS

The invention will now be illustrated by means of the annexed drawings which illustrate a preferred embodiment of the invention, given without any intention of limiting the scope of the invention, and in which.

DESCRIPTION OF PREFERRED EMBODIMENT

Figure 1:
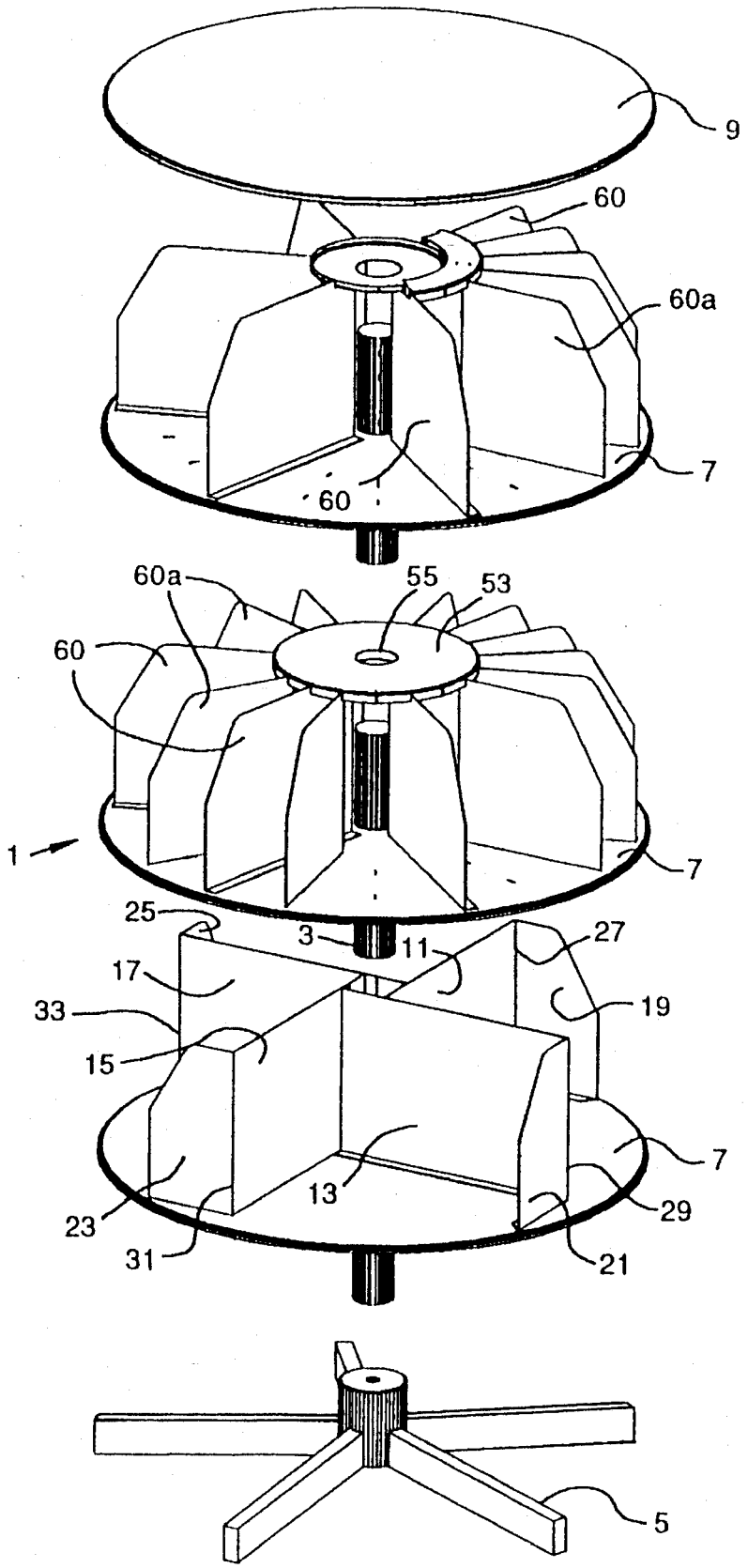
FIG. 1 is an exploded view in perspective of an example of rotary device according to the invention including three different rotors.

With reference to the drawings, it will be seen that a rotary filing and storage device 1 according to the present invention includes, as is well known to those skilled in the art, a center pillar 3 of known construction having its lower end disposed in known manner in a five-legged pedestal 5. Of course any other type of base or pedestal may be used, the choice being made for purposes of preference, design, cost or the like.

Other elements of the rotary device 1 include a plurality of circular plates or shelves 7 and a terminal plate 9, the illustrated assembly forming three individual and different tiers which may be used to store different articles or file documents. Of course, the rotary device may be constituted of as many tiers as its designer may choose, depending on the purpose and aim intended by the device. The rotary device 1 is finally completed by means of a terminal plate 9 as indicated above whose shape and appearance is entirely a question of design.

The center pillar 3, as in any rotary device of this kind is fixed and the three circular shelves 7 are each individually rotatably mounted with respect to the center pillar, in a manner (not illustrated), such as by means of a ball bearing system, which is well known to those skilled in the art and forms no part of the present invention.

Figure 2:
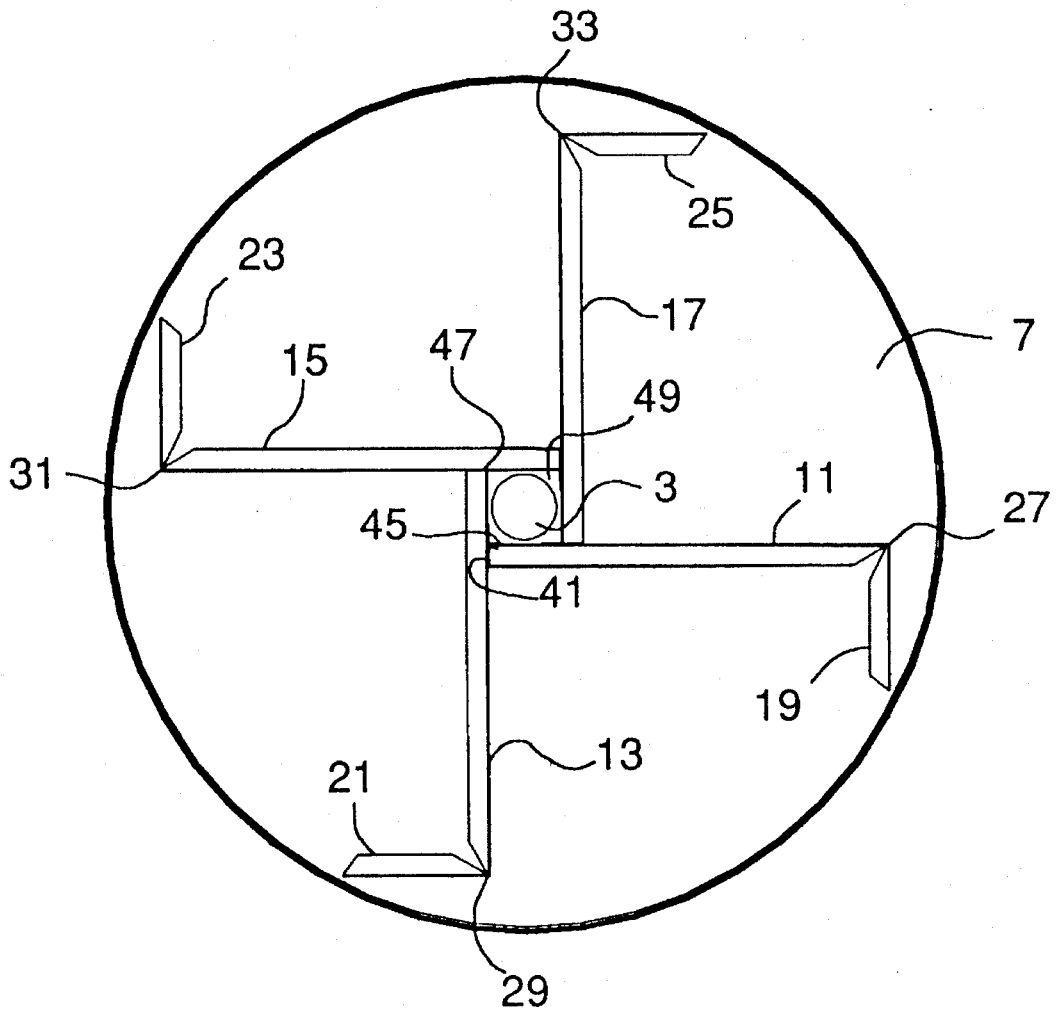
FIG. 2 is a cross-section view of the partitions and associated wings in the lower rotor of FIG. 1.

Referring first to the lower tier, four vertical partitions 11,13,15,17 are fixedly mounted, by any known means, on each circular plate. It will be noted that in the illustrated embodiment, two adjacent vertical partitions form a 90° angle with respect to one another, although the invention is not specifically limited to that particular design. With particular reference to FIGS. 1 and 2, it will also be seen that each vertical partition 11,13,15,17 is formed with a respective vertical wing 19,21,23,25. This is normally accomplished by folding along respective folding lines 27,29,31, 33. Of course any other way of providing a guard wing at the outer end of a partition is within the spirit and scope of the present invention.

In addition, it will be seen that each vertical partition extends as far away from its inner end just to ensure the presence of a corresponding guard wing. In this manner, use of the area of the plate or shelf 7 with documents or articles is maximized. In practice, the ratio between the length of the vertical partition and that of the wing is about 4:1 although it may be as high as about 40:1 and as low as 3:1.

It has also been found that the most practical way of disposing the partitions with respect to one another is to fix the inner end 41 (FIG. 2) for example of partition 11 against the inner face 45 of the next partition 13 (clockwise) at a point short of the inner end 47 of partition 13. This arrangement forms a rectangular void 49 allowing center pillar 3 to pass therethrough.

Figure 3:
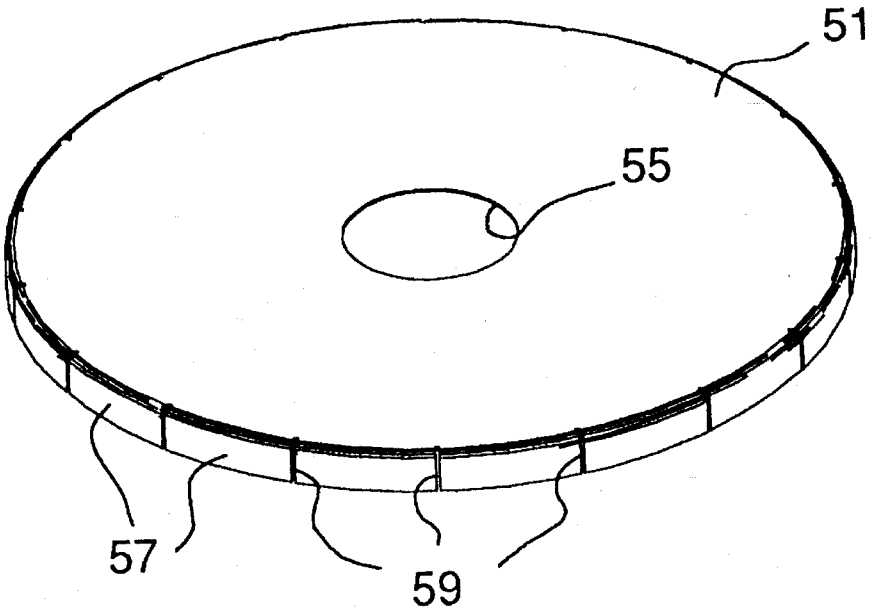
FIG. 3 is a perspective view of a file support.
Figure 4:
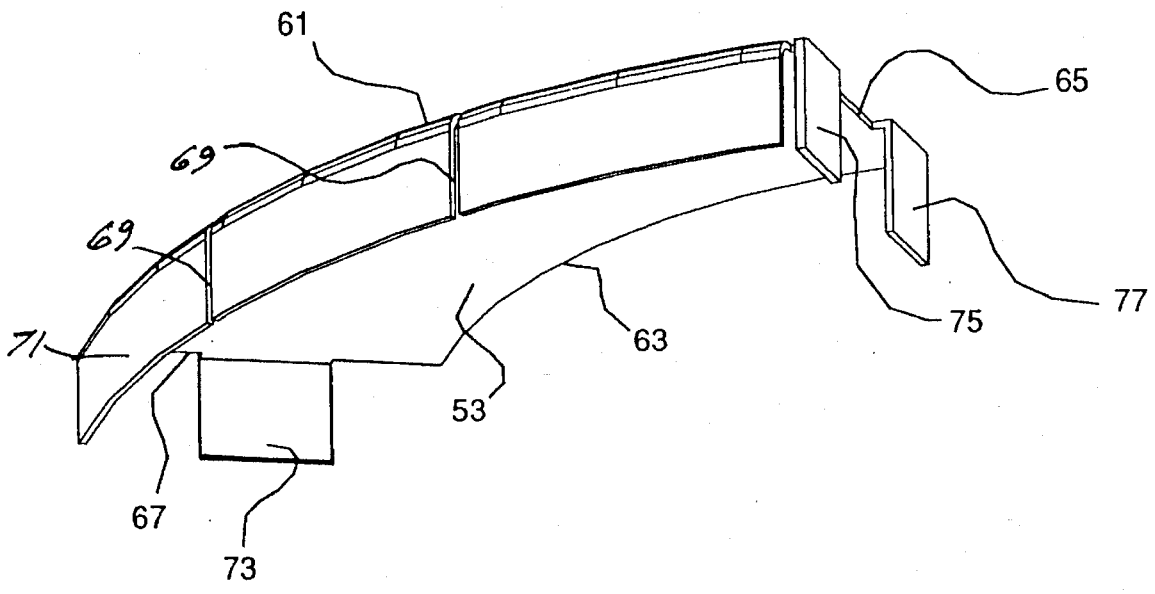
FIG. 4 is a perspective view of a removable file support according to the invention.

Turning to FIGS. 1, 3 and 4, two file rest supports are illustrated. The one illustrated in FIG. 3 covers the four compartments of the rotary device and is identified by reference number 51. FIG. 4 shows a removable file rest support 53. File rest support 51 is in the form of a disc member which has an opening 55 enabling the center pillar 3 to extend therethrough. So, when mounting rotary device 1, disc member 51 is simply inserted over center pillar 3. Disc member 51 is formed with a downwardly extending rim 57 which constitutes an abutment for resting the rear edges of files that one might wish to store in the rotary device according to the invention. In addition, vertical slits 59 formed in rim 57 are regularly distributed along the entire periphery of disc member 51. These slits 59 are wide enough to engage the upper edges of partitions 60 and the upper edges of any removable partitions 60a that might be introduced between vertical partitions 60. Furthermore, it will be realized that the disc member has a diameter which is pre-adjusted to the depth of the files intended to be disposed on any given circular plate 7.

Instead of disc member 51, if it is intended to cover only some of the compartments defined by the partitions 60,60*a*, removable file rest support 53 might be used. With particular reference to FIG. 4, it will be seen that the latter support is in the form of a section of annulus which has front and rear arcs 61,63 and two ends 65 and 67. A rim 69, similar to that of file rest support 51 is associated with the removable file rest support 53, and slits 71, similar to slits 59 are provided in rim 69. To mount support 53 in one compartment for the purpose of bridging two adjacent vertical partitions, one end 67 of the support is provided with a central downward tongue 73 and the other end 65 has two lateral downward tongues 75,77. These tongues are shaped and arranged so that when mounting two removable file rest supports adjacent one another to cover two neighboring compartments, tongue 67 fits exactly between tongues 75,77 of an adjacent support, and all tongues are engaged over a respective partition, e.g. 60.

It will be seen that the rotary device according to the invention, is adapted to contain a large variety of articles including files, which, if desired can be neatly arranged by having their rear edges abut against support 51 or support 53.

It is understood that the invention is not limited to the embodiments which have just been described except as defined by the appended claims.

I claim:

1. In a rotary device for storing articles and/or documents which includes an upstanding center pillar having one end disposed on a pedestal, at least one circular plate mounted for free rotation about said center pillar, means enabling said free rotation of said circular plate, and a plurality of partitions mounted vertically on at least one said plate, the improvement which comprises a file rest support disposed over said vertical partitions, wherein said file rest support is in the form of a disc member, said disc member having an opening to insert said center pillar therethrough, a downwardly extending outer rim constituting an abutment for resting rear edges of said files to be placed on said circular plates, and slits provided in said rim into which upper edges of said partitions are engaged, and additionally upper edges of any further removable partitions that may be introduced between two adjacent vertical partitions, said disc having a diameter adjusted to the depth of the files to be disposed on said circular plates, said file rest support limiting the extent of insertion of a file to a predetermined value.

2. A rotary device according to claim 1, wherein said file rest support is shaped as a section of annulus having a front arc and a rear arc and two ends, a rim downwardly projecting from said front arc, said rim being provided with slits to receive therein upper edges of said vertical partitions and additionally upper edges of any further removable partitions that may be introduced between two adjacent vertical partitions, downward tongues provided at the ends of said section of annulus and shaped to engage over the top edges of said partitions, said section of annulus having a width which is adjusted to the depth of files to be disposed on said circular plates.

3. A rotary device according to claim 1, which comprises a plurality of circular plates spaced arranged over one another.

4. A rotary plate according to claim 3, wherein said partitions are provided on each said circular plates.

5. A rotary device according to claim 3 which comprises a terminal plate mounted at the other end of said center pillar, spacedly from the uppermost circular plate.

* * * * *